United States Patent [19]

Claytor

[11] 4,338,859

[45] Jul. 13, 1982

[54] HUMIDIFYING AID

[76] Inventor: Bette Claytor, 360 Cobblestone Dr., Colorado Springs, Colo. 80906

[21] Appl. No.: 189,266

[22] Filed: Sep. 22, 1980

[51] Int. Cl.[3] ..... F24F 3/14

[52] U.S. Cl. ..... 98/105; 261/119 R

[58] Field of Search ..... 98/105, 109; 126/113, 126/134, 313; 261/119 R

[56] References Cited

U.S. PATENT DOCUMENTS

| | | | |
|---|---|---|---|
| 546,212 | 9/1895 | Wyman | 98/105 X |
| 966,842 | 8/1910 | Lewis | 98/105 |
| 1,183,746 | 5/1916 | Lesh | 98/105 |
| 1,887,242 | 11/1932 | Martinson | 126/113 X |
| 2,997,938 | 8/1961 | Sievert | 98/109 |

*Primary Examiner*—Albert J. Makay
*Assistant Examiner*—Harold Joyce
*Attorney, Agent, or Firm*—Bernard L. Kleinke

[57] ABSTRACT

A humidifying aid has a container having an open top for receiving water or the like. A pair of first and second upstanding arms extend from the container and terminate in a pair of transversely and outwardly extending ears for resting on the rim of an outlet opening for the furnace air recirculation system. Once the humidifying aid is disposed in its position, the grill cover for the outlet is placed over the humidifying aid for concealing the humidifying aid from view, while permitting access to it for replenishing the water supply therein. Thus, needed moisture is added to the recirculating air.

7 Claims, 5 Drawing Figures

FIG. 1
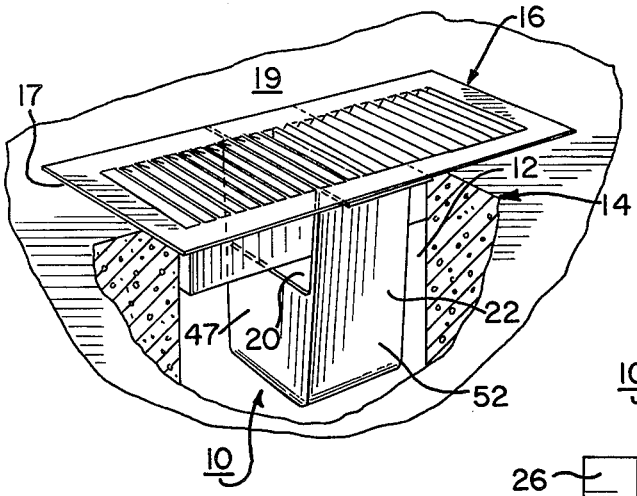
FIG. 4
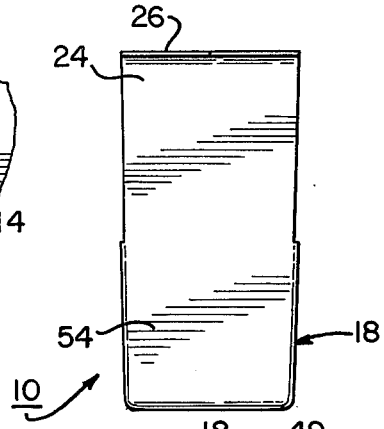
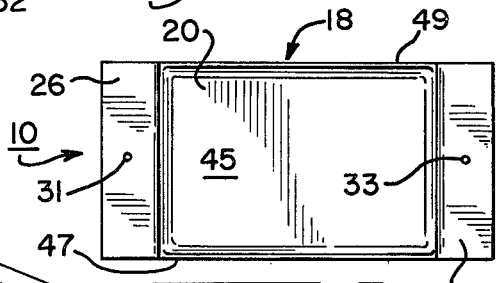
FIG. 5
FIG. 2
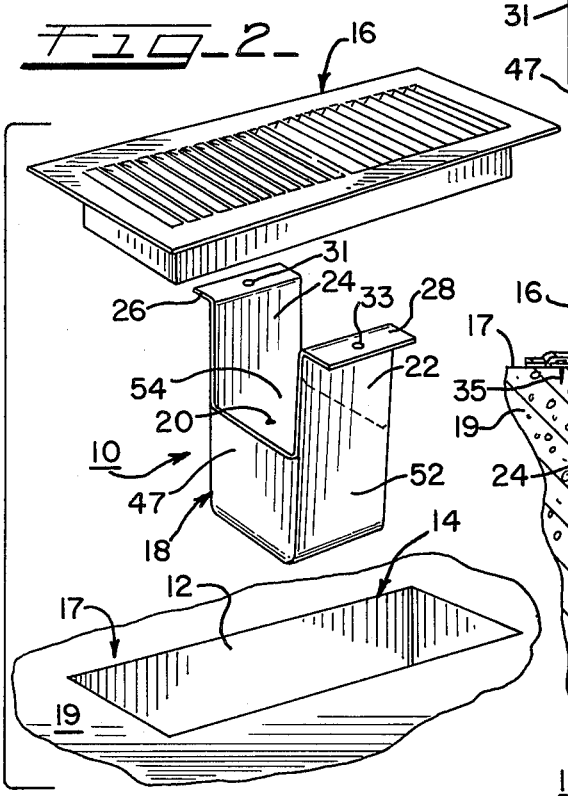
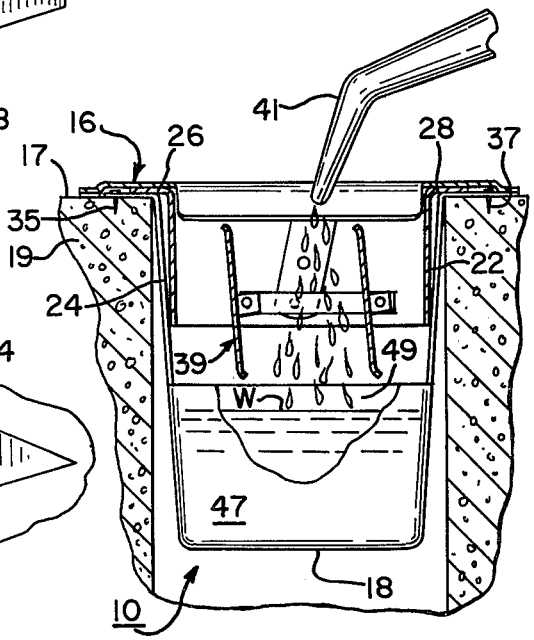
FIG. 3

HUMIDIFYING AID

TECHNICAL FIELD

The present invention relates in general to a humidifying aid, and it more particularly relates to a device used in a furnace air recirculation system for adding moisture to the recirculating air.

BACKGROUND ART

There have been many different types and kinds of humidifying devices which have been mounted in furnace air recirculation systems. For example, reference may be made to the following U.S. Pat. Nos. 1,183,746; 1,187,242; 2,138,709; 2,244,126; 2,363,953; and 2,790,374. The foregoing-mentioned patents disclose different types and kinds of humidifying devices used in forced air furnaces and the like. The devices shown in the aforementioned patents are generally in the form of specially built-in liquid containing reservoirs mounted within the air circulation system.

While such devices may be satisfactory for some applications, it would be highly desirable to have a humidifying aid which is adapted to be mounted in an existing furnace air circulation system, and which may be installed in a very simple and efficient manner. Also, the device should be readily and conveniently filled with water or similar liquids to replenish the supply, and it should help conserve energy. Moreover, such a device should be relatively inexpensive to manufacture. The device should be so relatively inexpensive to enable, if desired, a great number of similar such humidifying aids to be used at different locations within the building so that the overall cost is relatively inexpensive.

DISCLOSURE OF INVENTION

Therefore, the principal object of the present invention is to provide a new and improved humidifying aid, which can be readily and conveniently installed in existing furnace air recirculating systems, and which is relatively inexpensive to manufacture and to use.

Briefly, the above and further objects of the present invention are realized by providing a humidifying aid which has a container having an open top for receiving water or the like. A pair of first and second upstanding arms extend from the container and terminate in a pair of transversely and outwardly extending ears for resting on the rim of an outlet opening for the furnace air recirculation system. Once the humidifying aid is disposed in its position, the grill cover for the outlet is placed over the humidifying aid for concealing the humidifying aid from view, while permitting access to it for replenishing the water supply therein. Thus, needed moisture is added to the recirculating air.

Thus, the humidifying aid can be inserted into an air recirculation outlet in a matter of seconds, by merely removing the grill cover, inserting the aid in position, and then replacing the grill cover.

The aid is preferably a one-piece construction, and is composed of molded plastic material. Thus, the humidifying aids are relatively inexpensive to manufacture, and can be installed and used in a large number, if not all, of the rooms of a building, at a very modest cost. No additional energy is required to operate the humidifying aid of the present invention, thereby conserving energy.

The humidifying aid does not interfere with the normal operation of the air recirculating system or the outlet grill cover.

BRIEF DESCRIPTION OF DRAWINGS

The above-mentioned and other objects and features of this invention and the manner of attaining them will become apparent, and the invention itself will be best understood by reference to the following description of an embodiment of the invention taken in conjunction with the accompanying drawings, wherein:

FIG. 1 is a pictorial fragmentary view of a humidifying aid, which is constructed in accordance with the present invention, and which is shown installed in an outlet of a furnace air recirculation system;

FIG. 2 is a pictorial view of the humidifying aid of FIG. 1 of the drawings, illustrating the manner of installation;

FIG. 3 is a vertical cross-sectional enlarged view of the humidifying aid of FIG. 1, illustrating the manner in which the water may be added to the humidifying aid;

FIG. 4 is a side elevational view of the humidifying aid shown removed from the furnace outlet; and FIG. 5 is a plan view of the humidifying aid of FIG. 4.

BEST MODE OF CARRYING OUT THE INVENTION

Referring now to the drawings, and more particularly to FIGS. 1 and 2 thereof, there is shown a humidifying aid 10 which is constructed in accordance with the present invention, and which is shown disposed in the mouth 12 of a furnace air recirculation horizontal floor outlet 14 behind a floor register grill cover 16.

The humidifying aid 10 rests on and is suspended from a rim portion 17 of the outlet generally indicated at 14 surrounding the mouth 12, the rim portion being a part of the upper surface of the wooden floor 19. The outlet 14 is a conventional vertical shaft, opening at its upper end at the mouth 12, and is ordinarily connected in fluid communication with the remaining portion (not shown) of the furnace recirculation system (not shown) by means of a duct (not shown) or the like.

Preferably, the air recirculating system is a forced air system, and the outlet 14 is a hot air outlet. In this regard, hot air under pressure flows upwardly and exits the outlet 14 through the grill cover 16.

The humidifying aid 10 includes an opened-top, cup-shaped body 18 having an open mouth 20. The body 18 is constructed in a water tight manner, and thus, as shown in FIG. 3 of the drawings, the body 18 can be filled with water W. When installed in place and filled with water, the humidifying aid 10 causes moisture to be added to the hot air moving upwardly around and past the aid 18, as a result of the water evaporating and becoming entrained in the moving air.

A pair of vertical arms 22 and 24 extend upwardly from the open mouth 20 of the body 18. The upstanding arms terminate at their upper ends at the respective outwardly extending horizontal flanges 26 and 28. The flanges 26 and 28 are adapted to overlie the rim portion 17 of the outlet 14 under the grill cover 16. A pair of holes 31 and 33 in the respective flanges 26 and 28 are adapted to receive a pair of fastening devices, such as the nails 35 and 37, which may be driven into the rim portion 17 and through the respective holes 31 and 33 to secure the aid 10 in the mouth 12 of the outlet 14. However, it will become apparent to those skilled in the art that the use of the fastening devices is not essential.

As best seen in FIG. 2 of the drawings, the humidifying aid 10 is installed in place by first removing the grill cover 16 from the mouth 12 of the outlet 14. Thereafter, the humidifying aid 10 is lowered into the mouth 12 until the horizontal flanges 26 and 28 overlie and rest on the rim portion 17 of the floor 19 so that the body 18 is disposed within the mouth 12 of the outlet 14.

The grill cover 16 is then replaced over the aid 10. It should be noted that the depending movable louver 39 for the grill cover 16 is disposed above the body 18 when the movable louver 39 is disposed in its open position as shown in FIG. 3 of the drawings. Thus, the arms 22 and 24 are of a sufficient length to enable the movable louvers 39 to swing freely within the open position above the aid 10, as shown in FIG. 3 of the drawings, without engaging the body 18 of the humidifying aid 10.

In order to fill the body 18 with water, a container, such as a sprinkling can having a long pour spout 41, or a funnel (not shown), may be used to pour water through the open movable louver 39 through the open mouth 20 of the body 18 and fill it with water. In this manner, the supply of water can be replenished in the humidifying aid 10 in a very simple and convenient manner.

Considering now the body 18 in greater detail, the body 18 is generally rectangular in cross section, and the arms and flanges are integrally connected thereto. The entire construction of the humidifying aid 10 is of a one-piece construction. The humidifying aid 10 is composed of a suitable moldable plastic material, such as acrylonitrile butadiene styrene (ABS) plastic material, to withstand the high temperatures of the heated recirculating air.

The body 18 of the humidifying aid 10 is almost as wide as the width of the elongated rectangular mouth 12, and it is substantially shorter in length than the length of the mouth 12 of the outlet 14, so that air can flow around the humidifying aid 10 without unduly impeding its flow.

The body 18 includes a generally rectangular bottom wall 45 (FIG. 5). A pair of vertical parallel spacedapart upstanding side walls 47 and 49 and a pair of vertical parallel spaced-apart upstanding end walls 52 and 54, are all integrally connected to the bottom wall 45. The arms 22 and 24 form extensions of the respective end walls 52 and 54.

While a particular embodiment of the present invention has been disclosed, it is to be understood that various different modifications are possible and are contemplated within the true spirit and scope of the appended claims. For example, various different sizes and shapes of the humidifying aid are possible depending upon the size and shape of the air circulation system outlet. There is no intention, therefore, of limitations to the exact abstract or disclosure herein presented.

I claim:

1. A humidifying aid adapted to contain water or the like and to be mounted in a rectangular outlet opening of a furnace air recirculating system under an open grill cover having louvers depending into the outlet opening, comprising:

a generally rectangular body having an open top for receiving the water or the like, said body having a bottom wall and pairs of end and side walls;

a pair of first and second upstanding arms integrally connected to and extending upwardly from said end walls, said arms being flat and being substantially the same width as the width of their respective end walls to form integral extensions thereof, said arms being substantially longer than the height of the side walls of said body to position said body below the louvers for enabling said body to be disposed, below the louvers, by a substantial distance from the rim of the opening;

said arms terminating in a pair of transversely outwardly-extending ears, said ears being flat and extending at approximately right angles to their respective arms for fitting between the grill cover and the rim of the opening;

said arms and said body being composed of a unitary one-piece molded plastic material; and said side walls being substantially longer than said end walls and being almost the same length as the width of the rectangular opening to enable the body to extend thereacross, said end walls being substantially shorter in length than the length of the rectangular opening to enable the body to be positioned spaced from either end of the rectangular opening to provide air passage spaces at both sides thereof.

2. A humidifying aid according to claim 1, wherein said grill cover includes a downwardly movable louver, said arms being sufficiently long to space said body from the path of movement of the louver when disposed in its open position.

3. A humidifying aid according to claim 2, further including means defining openings in said ears for receiving fastening devices.

4. A humidifying aid according to claim 1, wherein said plastic material is acrylonitrile butadiene styrene material.

5. A humidifying aid according to claim 4, wherein the pair of end walls is oppositely-disposed and parallel spaced apart, and the pair of side walls is oppositely-disposed and parallel spaced apart.

6. A humidifying aid according to claim 5, further including means defining openings in said ears for receiving fastening devices.

7. A humidifying aid according to claim 6, wherein said grill cover includes a downwardly movable louver, said arms being sufficiently long to space said body from the path of movement of the louver.

* * * * *